United States Patent [19]

Higashi

[11] 4,083,176

[45] Apr. 11, 1978

[54] TIME CORRECTING SYSTEM FOR ELECTRONIC TIMEPIECE

[75] Inventor: Masato Higashi, Tokyo, Japan

[73] Assignee: Kabushiki Kaisha Daini Seikosha, Japan

[21] Appl. No.: 672,462

[22] Filed: Mar. 31, 1976

[30] Foreign Application Priority Data

Apr. 3, 1975 Japan ..... 50-40615

[51] Int. Cl.[2] ..... G04C 3/00; G04B 27/00

[52] U.S. Cl. ..... 58/23 R; 58/85.5; 328/48

[58] Field of Search ..... 58/23 R, 85.5; 235/92 T; 328/48

[56] References Cited

U.S. PATENT DOCUMENTS

| | | | |
|---|---|---|---|
| 3,817,020 | 6/1974 | Esaki | 58/85.5 |
| 3,841,081 | 10/1974 | Komaki | 58/85.5 |
| 3,852,951 | 12/1974 | Sauthier | 58/85.5 |
| 3,889,460 | 6/1975 | Yasukawa et al. | 58/85.5 |
| 3,948,035 | 4/1976 | Kusumoto | 58/85.5 |
| 3,961,472 | 6/1976 | Riehl | 58/85.5 |

*Primary Examiner*—Edith S. Jackmon

*Attorney, Agent, or Firm*—Robert E. Burns; Emmanuel J. Lobato; Bruce L. Adams

[57] ABSTRACT

A time correcting system for an electronic timepiece. The correcting system includes a single manually operable switch connected to a switching circuit for developing a chatter-free switching signal. A gate circuit is responsive to the switching signal for applying a time reference signal to time measuring circuitry of the timepiece. A counter is connected to receive a signal from a certain stage of a divider circuit of the timepiece for developing a count representative of the correcting mode of the correcting system. A resetting circuit resets all of the dividing stages of the dividing circuit when the counter develops a predetermined count and releases all of the divider stages from the reset state in response to opening of the manually operable switch. A first pulse generating circuit develops a pulse signal in response to termination of the switching signal before the counter develops a predetermined count in order to correct slow time. A flip-flop circuit set by the output signal of the first pulse generating circuit develops an output signal for enabling the divider circuit, and a second pulse generating circuit receives the output of the divider circuit for developing an output pulse to reset the flip-flop to disable the dividing circuit to correct fast time.

3 Claims, 4 Drawing Figures

TIME CORRECTING SYSTEM FOR ELECTRONIC TIMEPIECE

BACKGROUND OF THE INVENTION

This invention relates to a time correcting system for an electronic timepiece and more particularly to a time correcting system for adjusting both a slowing time and an advancing time. In an electronic timepiece, the reference pulse, for example which occurs at one second intervals, which is applied to a time measuring means, is the output signal of a dividing circuit receiving the output high frequency signal of oscillator including a quartz crystal resonator or the like. The converter such as stepping motor is actuated with the reference pulse and actuates hands such as a second hand to display time.

In such an electronic timepiece, the displayed time will be in error with variation of the oscillating frequency incorrect operation of the converter. Therefore, the displayed time has to be correctable.

If the time displayed is retarding or slowing, a correcting pulse but not the reference pulse is provided to the time measuring means. If the time displayed is advancing or running fast, the reference pulse is inhibited and not applied to the time measuring means.

Conventionally, in a time correcting system for an electronic timepiece there are switches for correcting slowing or retarding display time and advancing fast running display time. And there are independent circuits associated with these switches. Also, there is another switch to reset the dividing circuit.

Accordingly, in a conventional time correcting system, a space to set a plurality of switches is required. If these plural switches are replaced by multi-circuits and multi-contacts, the mechanism is complicated.

SUMMARY OF THE INVENTION

An object of this invention is to provide a time correcting system for an electronic timepiece having only one switch which functions to correct retarding displayed time, advancing time, the predetermined time and to reset the dividing circuit by selecting the operating duration of the dividing circuit.

DESCRIPTION OF THE PREFERRED EMBODIMENT

Figure 1:
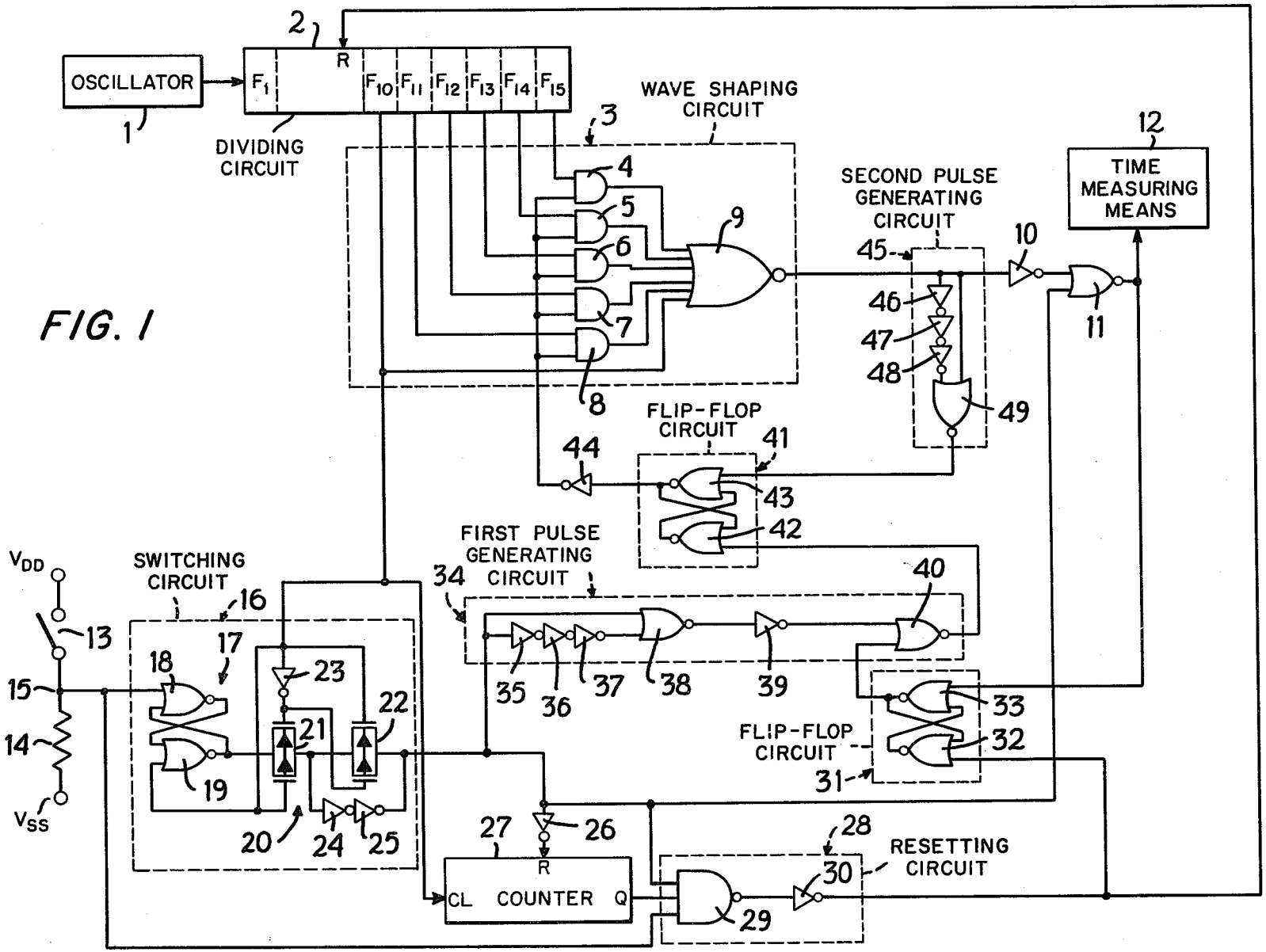
FIG. 1 is the circuit diagram of an embodiment of the time correcting system for an electronic timepiece according to the present invention.

Referring now to the preferred embodiment of this invention, FIG. 1 is the circuit diagram showing the time correcting system for an electronic timepiece of this invention.

In the drawings the reference numeral 1 is the oscillator employing a quartz crystal resonator or the like. The oscillator produces an output signal having a frequency of 32.768Hz.

The oscillator output signal is divided by the dividing circuit 2 comprised of 15 stages — dividing stages $F_1$ - $F_{15}$. The dividing stages $F_{10}$ - $F_{15}$ of the dividing circuit produce respectively the frequency outputs of 32Hz, 16Hz, 8Hz, 4Hz, 2Hz and 1Hz and the outputs of these dividing stages are provided to the wave shaping circuit 3.

Figure 2:
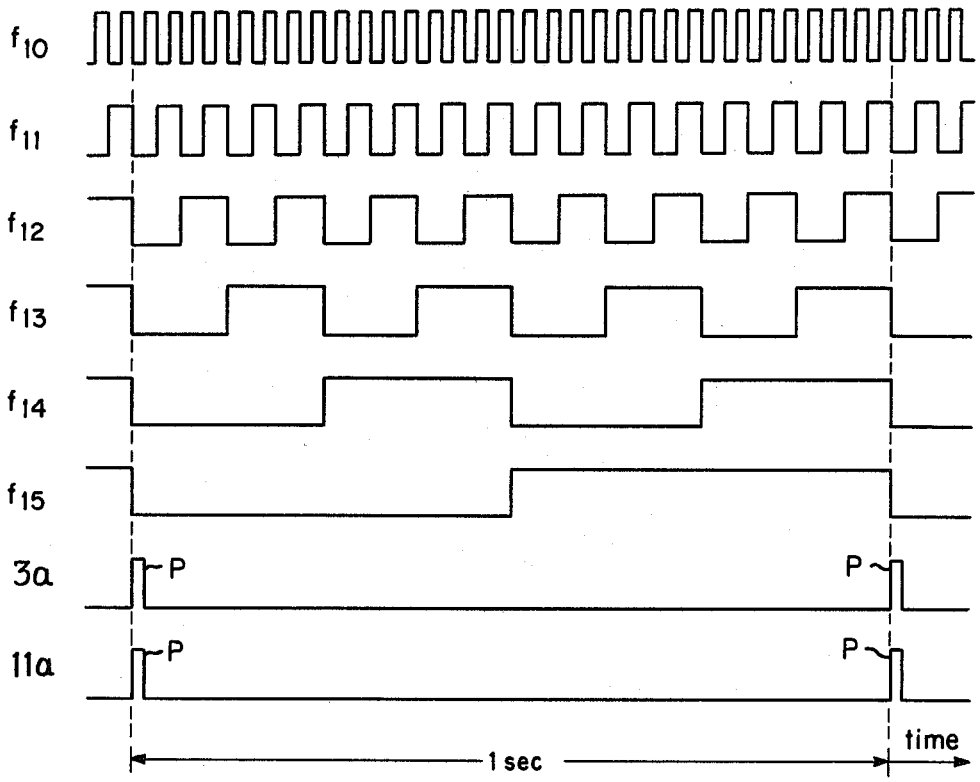
FIG. 2 is a timing chart illustrating waveforms developed during normal operation of the time correcting system illustrated in FIG. 1.

The wave shaping circuit 3 comprises AND circuits 4, 5 6, 7 and 8 receiving the outputs of the dividing stages $F_{11}$ - $F_{15}$ respectively, and NOR circuit 9 receiving the outputs of the dividing stage $F_{10}$ and AND circuits 4 - 8. The two-input AND circuits 4 - 8 respectively receive the output signals of the dividing stages $F_{11}$ - $F_{15}$ at one input terminal and receive the logical "1" signal inverted by the inverter 44 which receives a normal output signal, namely the logical "1" developed by the flip-flop circuit. Accordingly, the output waveform of the wave shaping circuit 3 in the normal state is the waveform shown at "3Q" in FIG. 2.

The wave shaping circuit 3 produces the reference pulse P of 15.6msec duration when a pulse corresponding to the output signal derived from the dividing stage $F_{10}$ developed and at the frequency of 1Hz. In the normal state, this reference pulse is applied to the time measuring means 12 through the inverter 10 and the NOR circuit 11 operating as a gate circuit.

The time measuring means 12 detailed structure is not for understanding this invention. Therefore, description of the time measuring means 12 is abbreviated.

Briefly, the time measuring means 12 comprises a driving circuit for generating the positive and negative driving pulses, a converter such as a stepping motor or the like driven by the driving pulses and a time display including hands such as the second hand activated by the converter. In the normal state, the second hand advance once every second in response to the above-mentioned reference pulse P.

Next, the time measuring means of this invention is described for the case when the displayed time is in error due to variation of the oscillating frequency of the oscillator 1 and or the incorrect operation of the converter.

The reference numeral 13 indicates the switch operable for time correction.

One switching contact connects to the power source terminal $V_{DD}$ corresponding to the logical "138 level voltage and another switching contact connects through the resistance 14 to the power source terminal Vss corresponding to the logical "0" level voltage.

The logical level at the nodal point 15 is normally at the "0" state but the signal of the logical level "1" with chattering is produced at the nodal point 15 in response to the close-operation of the switch 13. The signal at the nodal point 15 of the switch 13 is provided to the switching circuit 16 and the resetting circuit 28.

The switching circuit 16 functions to prevent the chattering derived from the switch 15 when it closes and opens, and to generate a correcting signal in order to correct the time in response to the operation of the switch. The switching circuit 16 comprises the flip-flop circuit 17 including NOR circuits 18, 19, the transmission gates 21, 22 and the latching circuit having the inverters 23, 24 and 25.

The NOR circuit 18 of the above-mentioned flip-flop circuit 17 receives the switching signal derived from the operation of the switch 13 and the NOR circuit 19 receives a signal of 32Hz derived from the dividing stage $F_{10}$. The output signal of the NOR circuit 19, namely, the output signal of the flip-flop circuit 17 is provided to the input terminal of the transmission gate 21 of the latching circuit and the output signal of the transmission 21 is provided to the input terminal of the transmission gate 22 through the inverters 24, 25. The output terminal of the transmission gate 21 connects to the output terminal of the transmission gate 22.

The control terminal of the transmission gate 21 receives through the inverter 23 the dividing circuit output signal derived from the dividing stage $F_{10}$. The switching circuit 16 normally receives the repetitive signal, including the logical level "1" and the logical level "0," derived from the dividing stage $F_{10}$ at the NOR circuit 19.

The output of the flip-flop circuit 17 is at the state of the logical level "0" because the logical level "0" is applied to the input terminal of the NOR circuit 18.

The output state of the inverter 25 which is the output state of the latching circuit 20 is at the logical level "0" since the output of the flip-flop circuit 17 is applied to the input terminal of the latching circuit 20. The output of the flip-flop circuit 17 changes to the logical level "1" when the output of the dividing stage $F_{10}$ is the logical level "0," and the state of the nodal point 15 changes to the logical level "1" with the operation of the switch 13. The output state of the latching circuit 20 changes from the logical level "0" to the logical level "1" because the transmission gate 21 is in the conductive state at this time.

The output of the flip-flop circuit 17 is not affected by chatter when the dividing stage $F_{10}$ is at state of the logical level "0," even if the switch 13 generates the chattering. When the switch 13 is operated at a time when the output of the dividing stage $F_{10}$ is at the logical level "0," the output state of the flip-flop circuit 17 remains at the state of the logical level "0" until the output state of the dividing stage $F_{10}$ changes to the logical level "0."

The output of the latching circuit 20, namely the switching circuit 16 becomes logical level "1" since the output of the flip-flop circuit 17 is inverted as mentioned above as soon as the output state of the dividing stage $F_{10}$ changes to the logical level "0."

The output signal of the flip-flop circuit 17 is affected by the chattering if the output state of the dividing stage $F_{10}$ changes from the logical level "0" to "1" in the duration of the chattering generated by the switch 13. However, the transmission gate 21 becomes nonconductive and the transmission gate 22 becomes conductive, at the time the output state of the dividing stage $F_{10}$ changes to the logical level "1."

The output signal of the flip-flop circuit 17 is latched by the latching circuit 20 whereby the correcting signal without the chattering is produced from the switching circuit 16. And the electric signal of the logical level "0" without the chattering is produced from the switching circuit 16 since the flip-flop circuit 17 and the latching circuit 20 are acutated with the open-operation of the switch 13.

As mentioned above, the correcting signal of the logical level "1" without the chattering is produced from the switching circuit 16 in response to the operation of the switch 13. The resetting terminal R of the six bit binary counter 27 receives, through the inverter 26, the output signal of the switching circuit 16.

The clock-terminal CL of the counter 27 receives the 32Hz - signal derived from the dividing stage $F_{10}$.

Normally, the output terminal Q of the counter 27 produces the logical level "0" and the counter 27 does not count because the resetting terminal R of the counter 27 receives the signal of the logical level "0".

Herein, the correcting signal of the logical level "0" is produced from the switching circuit 16 with the operation of the switch whereby the counter 27 is inhibited to reset and counts the dividing signal of 32Hz applied to the input terminal CL. And the counter 27 counts 32 pulses whereby the output terminal Q of the counter 27 produces the electric signal of the logical level "1."

However, in case that the operating-duration of the switch 13 is short and the generating-duration of the correcting signal derived from the switch circuit 16 is below 1 second, the counter 27 which does not yet count 32 pulses is reset whereby the output state of the output terminal Q maintains the logical level "0."

The output signal of the counter 27 is applied to the input terminal of the NAND circuit 29 in the resetting circuit 28 together with the electrical signal at the nodal point 15 and the output signal of the switching circuit 16.

The resetting circuit 28 is composed of the NAND circuit 29 and the inverter 30 which inverts the output of the NAND circuit 29, and the output signal of the resetting circuit 28 is applied to the resetting terminal R of the dividing circuit 2 and to the flip-flop circuit 31.

The flip-flop circuit 31 is composed of the NOR circuit 32 receiving the output signal of the resetting circuit 28 and the NOR circuit 33 receiving the output signal of the NOR circuit 11. And the output of the flip-flop circuit 21 produced from the output of the NOR circuit 33 is normally at the logical level "0." The output signal of the switching circuit 16 is applied to the NOR circuit 11 acting as a gating circuit, and to the first pulse generating circuit 34.

The first pulse generating circuit 34 is composed of the delay circuit including the inverters 35, 36 and 37, the NOR circuit 38 receiving the output signals of the delay circuit and the switching circuit 16, and the NOR circuit 40 receiving the output signal of the NOR circuit 38 through the inverter 39, and the output signal of the flip-flop circuit 31.

The output state of the first pulse generating circuit 34 which is the output state of the NOR circuit 40 is normally the logical level "0."

However, the NOR circuit 40 produces a pulse having a logical level "1" on the condition that the output state of the flip-flop circuit 31 is the logical level "0" because the output of the NOR circuit 38 changes to the logical level "1" for a duration corresponding to the sum of the delay time of inverters 35, 36 and 37 at the falling time that the output state of the switching circuit 16 changes from logical level "1" to "0."

The output pulse of the first pulse generating circuit 34 is applied to the flip-flop circuit 41, composed of the NOR circuit 42 and the NOR circuit 43, whereby the flip-flop circuit 41 is set. The output state of the flip-flop circuit 41 is the output state of the NOR circuit 43 and is normally the reset state but is set by the pulse signal derived from the first pulse generating circuit 34.

The output signal of the flip-flop circuit 41 is applied to the respective AND circuits 4 - 8 of the wave shaping circuit 3 through the inverter 44.

The resetting terminal of the flip-flop circuit 41 is the input terminal of the NOR circuit 43 and receives the pulse signal derived from the second pulse generating circuit 45.

The second pulse generating circuit is composed of the NOR circuit 49 of which the input terminal receives the output signal of the wave shaping circuit 3 and of which the another input terminal receives the output signal of the wave shaping circuit 3 delayed through the inverters 46, 47 and 48. The output signal of the second pulse generating circuit 45 is produced from the output terminal of the NOR circuit 49.

At the time that the output state of wave shaping circuit 3 falls from the logical level "1" to the logical level "0," the pulse of the logical level "1" having a pulse width corresponding to the delay time of the inverters 46, 47 and 48 is produced.

The flip-flop circuit 41 is reset with the pulse from the second pulse generating circuit 45 whereby the output state of the flip-flop circuit 41 is maintained at the logical level "0."

Next, the operation of time correcting system for an electronic timepiece having the above structure is described.

In the case that the time displayed with the time measuring means 12 is retarding or slowing, the correcting pulse in addition to the reference pulse is provided to the time measuring means 12 by the operation of the switch 13 within 1 second whereby a desirable time correction is made.

Figure 3:
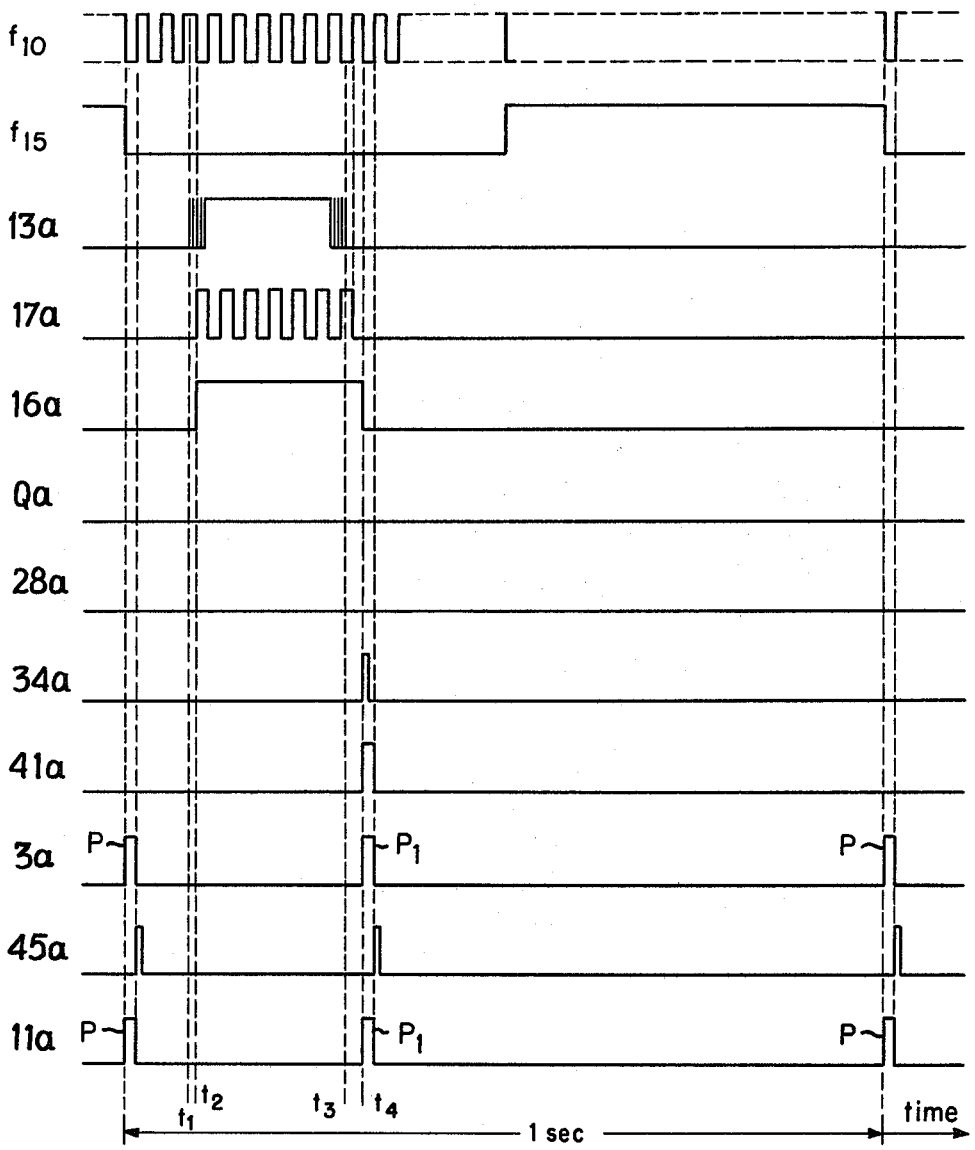
FIG. 3 is a timing chart illustrating waveforms developed during operation of the time correcting system according to the present invention in a mode for correcting slowing time; and, FIG. 4 is a timing chart illustrating waveforms developed during operation of the time correcting system according to the present invention in a mode for correcting fast time.
Figure 4:
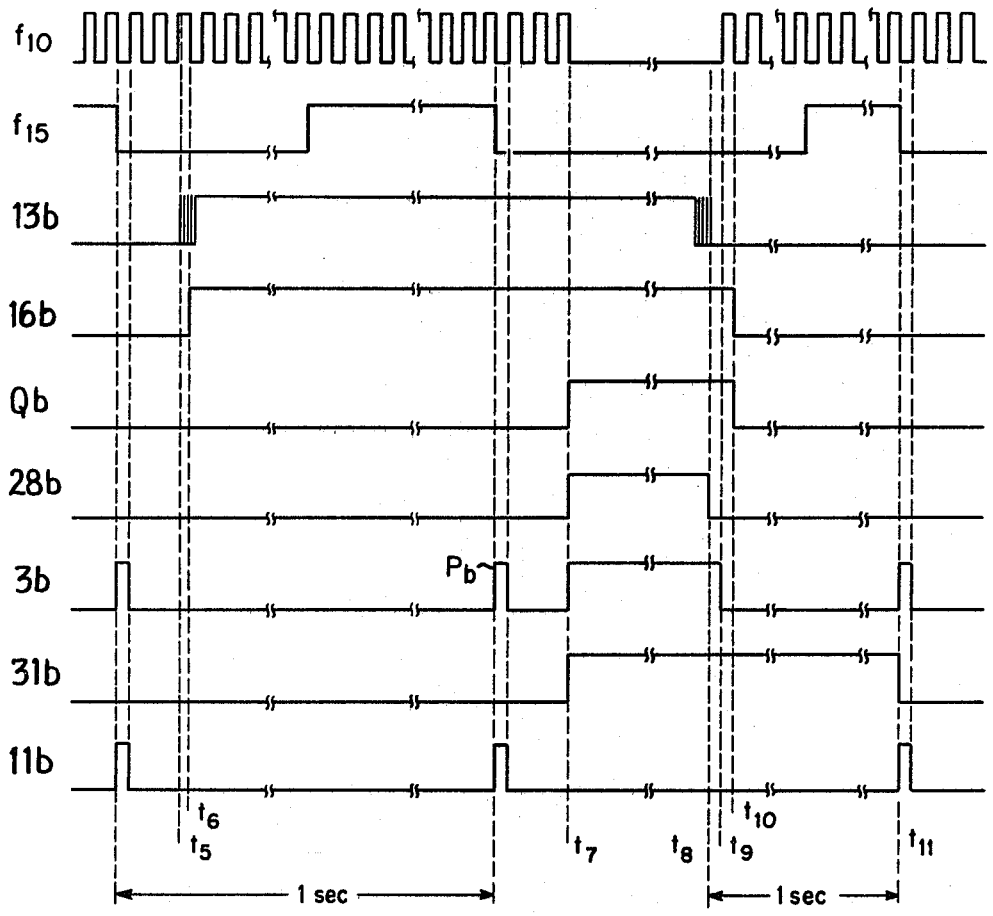

Referring to the operation in accordance with the timechart as shown in FIG. 3.

The switch 13 is operated at the time $t_1$, and the output state of the flip-flop circuit 17 becomes the logical level "1" at the time $t_2$ that the dividing signal shown as the wave form $f_{10}$ derived from the dividing stage $F_{10}$ changes to the logical level "0." The flip-flop circuit 17 produces the electric signal having the wave form $f_{10}$ and the inverted wave form 17*a* for the duration of the operation of the switch 13.

The output signal of the latching circuit 20, namely the switching circuit 16 in response to the output signal of the flip-flop circuit 17 changes to the logical level "1" as shown in wave-form 16*a* at the time $t_2$ and is maintained at the logical level "1" until the time $t_4$ after the switch 13 is opened at the time $t_3$. Namely, the correcting signal without the chattering having the logical level "1" is produced from the switching circuit 16 with the operation of the switch 13.

The time measuring means 12 is inhibited from receiving the reference pulse even if the reference pulse is produced from the wave shaping circuit 3 because the state of the input terminal of the NOR circuit 11 acting as a gating circuit for the reference pulses is maintained at the logical level "1."

The counter 27 which is inhibited to reset by the correcting signal starts to count the input signal but the counter 27 is reset at the same time as the generation of the correcting signal before a counting pulse is produced from the output terminal Q because the operating duration of the switch 13 is within 1 second. Accordingly, the outputs of the counter 27 and the resetting circuit 28 is maintained at the logical level "0" as shown by the waveforms Q*a* and 28*a*.

On the other hand, at the time $t_4$, the generation of the correcting signal is stopped and the input signal of the first pulse generating circuit 34 falls to the logical level "0" from the logical level "1."

At the falling time, the first pulse generating circuit 34 produces the pulse signal of the logical level "1" with a pulse width corresponding to the delay time of the inverters 35, 36 and 37, as shown in the waveform 34*a*. The flip-flop circuit 41 changes to be the set-state with this pulse so that the output of the flip-flop circuit 41 is inverted to the logical level "1" as shown in the waveform 41*a*.

The output state of the flip-flop circuit 41 changes to the state of the logical level "1."

The electric signal of this logical level "1" is applied to the input terminals of the AND circuits 4 – 8 through the inverter 44 so that the correcting pulse $P_1$ of the logical level "1" as shown in the waveforms 3*a* is produced from the NOR circuit 9 at the time that the output state of the dividing stage $F_{10}$ changes to the state of the logical level "0."

At the time that the correcting pulse $P_1$ is produced, the correcting pulse $P_1$ is provided to the time measuring means 12 through the inverter 10 and the NOR circuit 11 because the correcting signal eliminates already. On the other hand, at the time that the correcting pulse $P_1$ falls, the second pulse generating circuit 45 produces the resetting pulse having a pulse width corresponding to the delay time of the inverters 46, 47 and 48 whereby the flip-flop circuit 41 is reset. Accordingly, all of the circuits return to the normal state at the time that one correcting pulse is produced.

As mentioned above, in case that the operating duration of the switch 13 is within one second, the NOR circuit 11 produces the correcting pulse $P_1$ together with the reference pulse P. Therefore, the retarding time is corrected by the operation of switch 13 a number of times corresponding to the retarding time.

Next, the time correcting action is described for the case that the displayed time is advancing.

The switching circuit 16 produces the correcting signal of the logical level "1" at the time $t_6$ as shown in the waveform 16*b* by operation of the switch 13 at time $t_5$ as shown in the waveform 13*b*.

The counter 27 produces the counting output derived from the output terminal Q because the counter 27 counts modulo 32 the dividing output signals from the dividing stage $F_{10}$ upon closing of the switch for over 1 second.

The resetting circuit 28 produces the resetting signal of the logical level "1" as shown in the waveform 28*b* because all signals providing to the NAND circuit 29 of the resetting circuit 28 are of the logical level "1" by this counting output. The dividing circuit 2 is reset and the output state of the flip-flop circuit 31 changes to be inverted to the logical level "1."

The reference pulse Pb, produced from the wave shaping circuit 3, as shown for the waveform 3*b*, in the duration of the correcting signal from the switching circuit 16 by the operation of the switch 13, is not applied to the time measuring means 12 since the reference pulse Pb is not produced at the output terminal of the NOR circuit, as shown at the one point dotted line in the waveform 11*a* because one input terminal of the NOR circuit 11 is maintained at the state of the logical level "1" by the correcting signal.

The dividing circuit 2 is reset whereby the dividing signal provided to the wave shaping circuit 3 becomes to be the logical level "0." Therefore, the output terminal of the wave shaping circuit 3 produces the electric signal of the logical level "1".

Also, this electric signal is not produced at the output terminal of the NOR circuit. Accordingly, for the duration of operation of the switch 13, the second hand is maintained stopped since the time measuring means 12 does not receive the pulse signal.

At the time $t_8$, at the time that the switch 13 becomes open, the one input signal of the NAND circuit 29 changes to the state of the logical level "0" whereby the output state of the resetting circuit 28 changes to be the logical level "0" and the dividing circuit 2 is inhibited to be reset.

At the time $t_9$ that the output state of the dividing stage $F_{10}$ changes from the logical level "0" to the logical level "1," that is, at the time $t_9$ that is in 15.6 msec after the dividing circuit 2 is inhibited to be reset, the output state of the wave shaping circuit 3 becomes the logical level "0" and the output state of the flip-flop circuit 17 becomes the logical level "0."

Further, at the time $t_{10}$ that the output state of the dividing stage $F_{10}$ changes to the logical level "0" after the 15.6 msec delay, the switching circuit 16 does not produce the correcting signal whereby the counter 27 is reset and the output state of the output terminal Q changes to the logical level "0."

At the time that the output state of the switching circuit 16 falls to the logical level "0," The NOR circuit 38 of the first pulse generating circuit 34 produces the pulse of the logical level "1" with the pulse width corresponding to the delay of the inverters 35, 36 and 37.

However, the output state of the first pulse generating circuit 34 maintains to be the state of the logical level "0" because the NOR circuit 40 receives the electric signal of the logical level "1" inverted by the flip-flop circuit 31 at the time $t_7$, as shown in the waveform 31*b*. Accordingly, the output state of the flip-flop circuit 41 does not change.

At the time $t_{11}$, 1 second after the time $t_8$, the reference pulse P is produced from the output terminal of the wave shaping circuit 3 and is provided to the time measuring means 12 through the inverter 10 and the NOR circuit 11.

The flip-flop circuit 31 is reset by the output signal of the NOR circuit 11 and becomes the logical level "0" whereby each of the circuits change to be the normal state.

As mentioned the above, the second hand stops for the operating duration if the switch 13 operates over one second, since the reference pulse is not applied to the time measuring means 12. However, the second hand starts to act at one second after the open-operation of the switch 13. Accordingly, the advancing correction of the time is made by controlling the operating-time of the switch 13 for an interval corresponding to the advancing time. The operation of the switch 13 over one second is effective for the resetting operation of the dividing circuit 2.

The scope of this invention is not limited to the embodiments described and includes modifications of the disclosed embodiments.

For example, since the counter 27 comprises the six bit binary counter, the retarding correction of the time is made if the closing-operation of the switch 13 is for less than one second and the advancing correction of the time is made if the closing-operation of the switch 13 is over 1 second. The switch 13 operating time of the retarding and the advancing correction is possible to be changed by varying the bit-number of the counter.

As mentioned above, with the time correcting system for an electronic timepiece it is possible to select the retarding correction and the advancing correction by adjusting the operating time of the only switch. In the case that the retarding time is corrected, the correcting pulse different from the reference pulse is provided to the time measuring means and the correction of the retarding time is made by controlling the number of times the switch is operated.

On the other hand, in the case that the advancing time is corrected the reference pulse is inhibited from being applied to the time measuring means upon the closing of the switch for an interval corresponding to the corrected time whereby the advancing time is corrected. Further, the dividing circuit is resetted by the common switch in accordance with this invention. Therefore, the conventional time correcting system for an electronic timepiece employes a plurality of switches is improved upon by this invention.

I claim:

1. In an electronic timepiece, the combination comprising: an oscillator circuit for developing an oscillatory output signal; dividing circuit means comprised of a plurality of dividing stages connected in cascade for receiving the oscillatory output signal and for developing a time reference signal having a frequency representative of time; time measuring means receptive of the time reference signal for measuring and displaying time; and a time correcting system for correcting the time measured by said time measuring means, said time correcting system comprising a single manually operable switch operable between an open and a closed condition for controlling an electrical signal applied thereto, a switching circuit connected to said switch for developing a chatter-free switching signal indicating opening or closure of said switch, a gate circuit receptive of said time reference signal and responsive to said switching signal for applying the time reference signal to said time measuring means, a counter connected to receive a signal from a certain stage of said dividing circuit for counting the signal from said certain dividing circuit stage and for developing a count representative of the correcting mode of said correcting system, resetting circuit means for resetting all of said dividing stages of said dividing circuit when said counter develops a predetermined count and for releasing all of said divider stages from the reset state in response to opening of said switch, first pulse generating circuit means for developing a pulse signal in response to termination of said switching signal before said counter develops a predetermined count, a flip-flop circuit set by the output signal of said first pulse generating circuit and developing an output for enabling said divider circuit, and second pulse generating circuit means receptive of an output of said divider circuit for developing an output pulse to reset said flip-flop.

2. In an electronic timepiece according to claim 1, wherein said divider circuit means further comprises: a wave shaping circuit comprised of a plurality of two-input AND gates each having a first input connected to a respective dividing stage and a second input connected to receive the output of said flip-flop; and a NOR gate receptive of the respective outputs of said AND gates.

3. In an electronic timepiece according to claim 1, wherein said pulse generating circuit means each comprise a plurality of inverter circuits connected in series, and a two input NOR gate having a first input connected to an output of said plurality of inverters, and a second input connected to an input of said plurality of inverters.

* * * * *